United States Patent [19]

McCain et al.

[11] Patent Number: 4,482,142

[45] Date of Patent: Nov. 13, 1984

[54] METHOD OF SIGNATURE COLLATING OF DIFFERENT EDITIONS

[75] Inventors: William B. McCain, Hinsdale, Ill.; Todd S. Rankin, Fairfield, Conn.

[73] Assignee: McCain Manufacturing Corporation, Chicago, Ill.

[21] Appl. No.: 454,724

[22] Filed: Dec. 30, 1982

[51] Int. Cl.[3] ..... B65H 39/02

[52] U.S. Cl. ..... 270/54

[58] Field of Search ..... 270/54–58

[56] References Cited

U.S. PATENT DOCUMENTS

| | | | |
|---|---|---|---|
| 3,608,888 | 9/1971 | McCain et al. | 270/54 |
| 3,774,901 | 11/1973 | McCain et al. | 270/54 |
| 3,809,385 | 5/1974 | Rana | 270/54 |
| 3,819,173 | 6/1974 | Anderson et al. | 270/54 |
| 4,022,455 | 5/1977 | Newsome et al. | 270/54 |
| 4,168,828 | 9/1979 | Mclear | 270/54 |

FOREIGN PATENT DOCUMENTS

| | | | |
|---|---|---|---|
| 2509579 | 9/1975 | Fed. Rep. of Germany | 270/54 |
| 623756 | 9/1978 | U.S.S.R. | 270/54 |

*Primary Examiner*—E. H. Eickholt

*Attorney, Agent, or Firm*—Kinzer, Plyer, Dorn & McEachran

[57] ABSTRACT

A method of collating binder production of books in a sequence of different editions, which differ as to content, to another sequence on a conveyor so they will be delivered in the other sequence from the conveyor.

4 Claims, 9 Drawing Figures

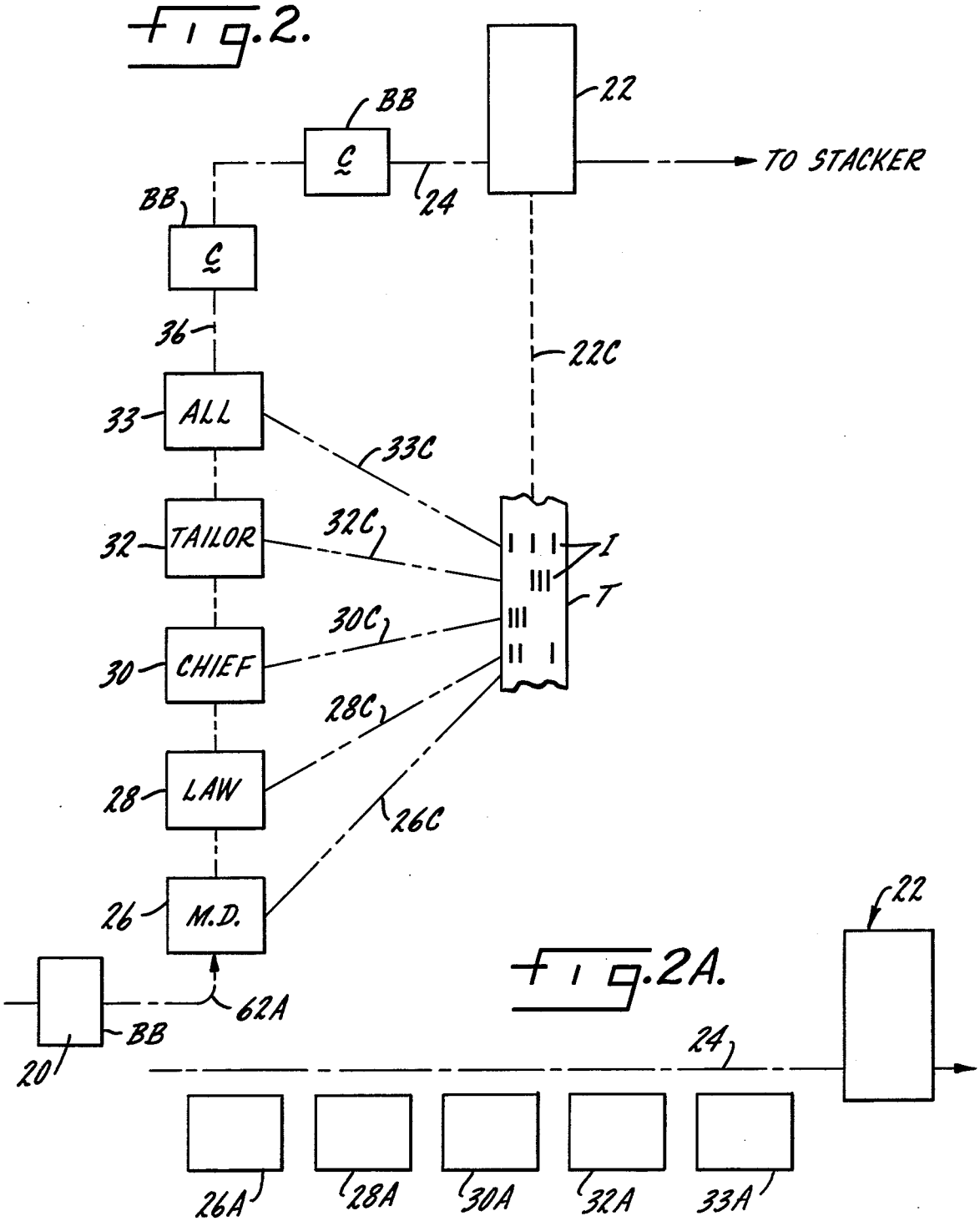
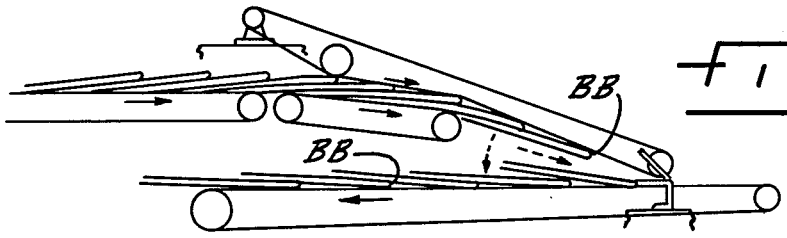
fig. 8.

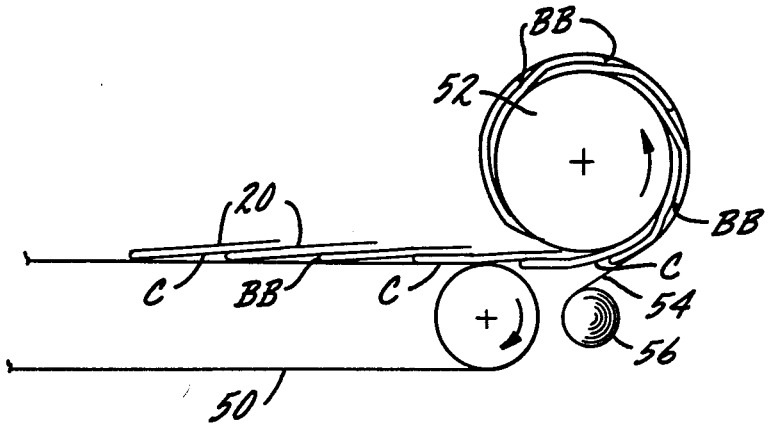
Fig. 5.
Fig. 6.
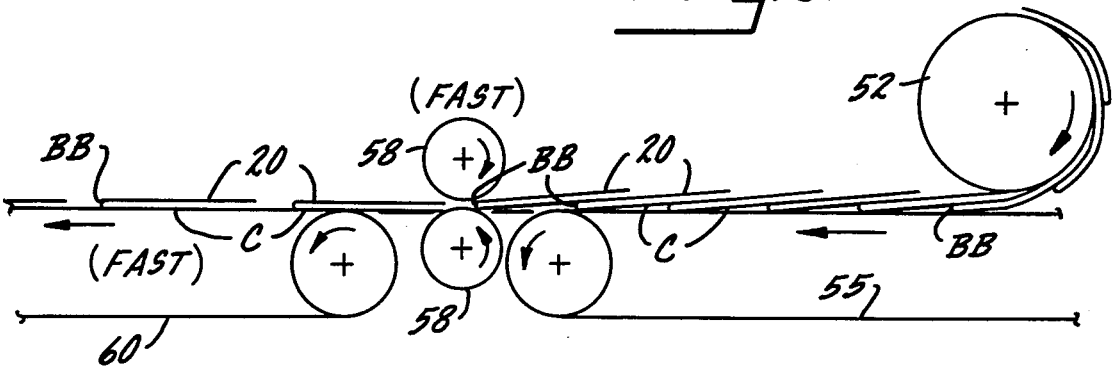
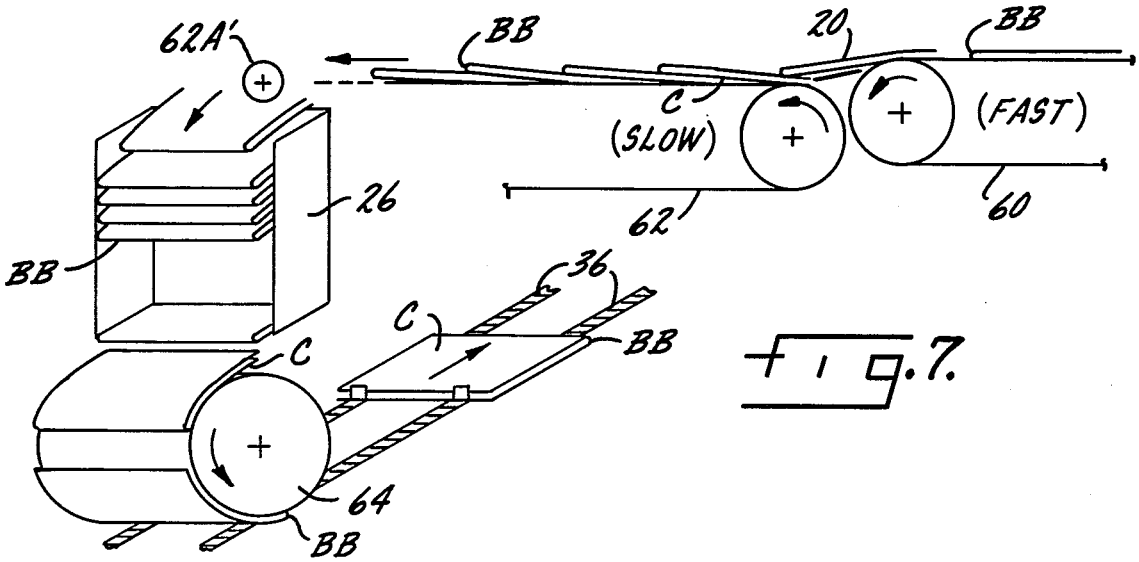
Fig. 7.

METHOD OF SIGNATURE COLLATING OF DIFFERENT EDITIONS

This invention relates to signature machines and in particular to a method or system for collating expeditiously mailing labels applied to books or magazines composed of the signatures, or collating the books to some other predetermined order or sequence for distribution in terms of demographics or some other difference, referred to herein as editions.

The collation system contemplated by the present invention will be described in terms of collating different editions of a subscription magazine to a labeler but the invention is by no means limited to that application.

Each magazine is composed of signatures gathered in a signature machine, bound together (usually by staples) and subsequently, in most instances, delivered to a trimmer where the top, bottom and front edges are trimmed to uniform size. A trimmer may not always be used used but certainly the signatures will be bound in one way or another to complete the book. The signatures may be bound into books by staples or by square back binding and the signatures may be collected on a saddle gatherer or by a side gatherer. In the present disclosure, the term "binder" or "binder station" is used in a comprehensive sense indicative of the combination of a binder such as a stitching head and an in-line trimmer, or the binder alone without a trimmer.

To save time and space the books emitting from the binder station are usually imbricated, that is, overlapped in a constant stream. One common practice today is to hand-collect the books emitting from the binder and pass them in bunches to hoppers (or some other form of feeder) which supply the mailing machine. At the mailing machine, labels are applied bearing the name, address and zip code. Labelling may be done by a jet spray printer. Sometimes, the books emitted at the binder station may be hand-loaded onto skids or pallets for manual movement within the same plant, or to an adjacent plant where the mailing machine is located. One object of the invention is to eliminate the need for these tasks while, in a different way, assuring that the books are charged into the mailing machine feeders in the correct orientation; but more importantly and significantly it is an object of the invention to capture and harness the books produced at the binder station in such a way that the mailing hoppers or feeders may be charged or fed with considerable facility while at the same time maintaining a separation between the various editions of the book produced at the bindery since this procedure can result in a considerable mailing discount. While the preferred mode of practice (and the best mode now known) will be described in terms of distributive mailing while applying zip coded labels the distribution may involve some other mode, the addresses may be printed or presented in some other way and the editions may vary from the specific example given.

IN THE DRAWING

FIGS. 1 and 2 are schematic plans of a stream of magazines in the process of receiving address labels;

FIG. 2A is a detail view similar to FIG. 1 showing a modification;

FIG. 5 is a detail view, in elevation, of a windup cylinder in action;

FIG. 6 is a view similar to FIGS. 4 and 5 showing delivery of the magazines from the windup cylinder and subsequent disruption of the imbrication;

FIG. 7 is a view partly in schematic elevation and partly in perspective showing reorientation of the magazines prior to charging the mailing hopper; and FIG. 8 is a detail of another way of orienting.

Figure 1:
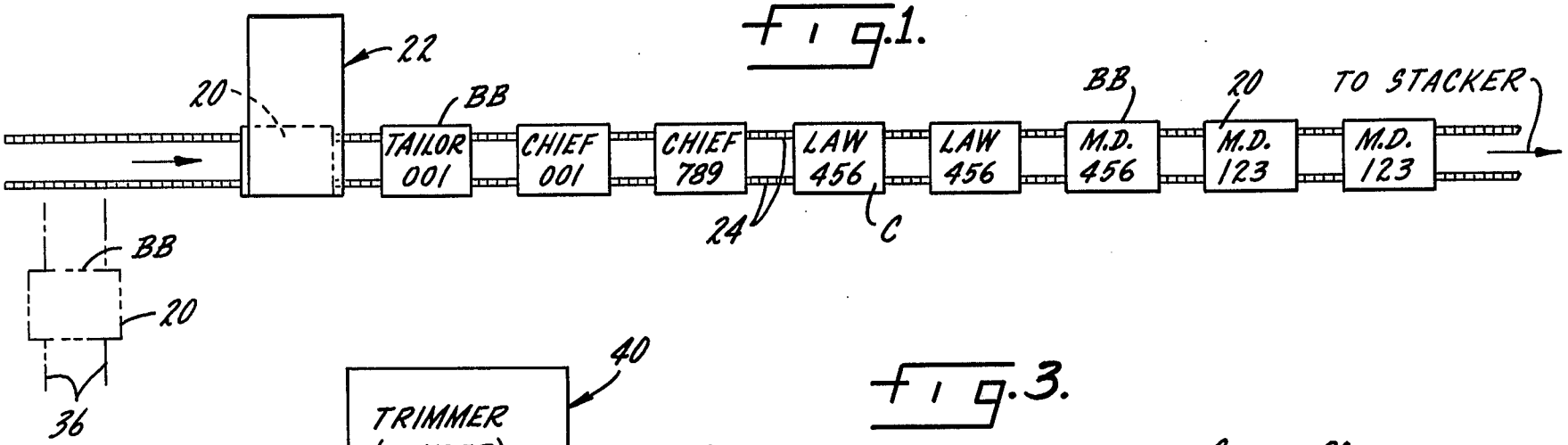

The problem faced under the present invention may be introduced by referring to FIG. 1 which is a partly schematic and partly diagrammatic view of a string of books 20 which are moving from left to right as viewed in FIG. 1, each with a mailing label applied by a labeler 22. The final step of zip code bundling or stacking is done at a stacker, not shown, but it will be noted that a legend has been applied in FIG. 1 to show the flow of labeled books to the stacker.

The supply of labels present at the labeler is in a predetermined order according to editions. Three doctors or physicians (MD) are receiving the magazine. The first two physicians (MD) reside within zip code "123" and the third physician resides within zip code "456". There may be other subscribers in zip code "123" receiving the magazine but for disclosure purposes it is assumed these other persons are not receiving the same edition as the doctors, that is, the edition for the doctors contains articles or advertisements pointed specifically at them, and this (MD) edition, as will be explained, has a particular (downstream) mailing hopper (26, FIG. 2) assigned to it. In other words, the (MD) articles or advertisements inside the magazine are deemed for present purposes to be of no interest to another subscriber.

Again, while there is only one doctor in zip code "456" receiving the (MD) edition, there may be others in this same zip code receiving the subscription at the same time. This is so because the usual plan for the publisher or printer is to group all common zip codes together which reduces mailing costs.

Again referring to FIG. 1, another professional group is receiving a separate edition, pointed at them, and it so happens they are represented by two lawyers (LAW) both residing in zip code "456". The edition for the lawyers is followed by an edition for a chief residing in zip code "789" and another chief residing in zip code "001"; finally there is a tailor also in zip code "001", serving to illustrate the mailing principle of zip code consistency to save mailing costs.

Again referring to FIG. 1, the flow beneath and past the labeler 22 is effected by chains or other carriers 24 having pushers (not shown) engaging the trailing edge of each book; the fold or backbone of each book is identified by BB and the front cover C of the magazine faces upward. This orientation is typical and in this connection it should be mentioned that we take into account a known labeler and mailer, and also a known trimmer and mailing hopper, but we are not limited thereto.

FIG. 2 is a diagrammatic view of an arrangement under the invention for delivering the books to the conveyor feeder 24 which feeds the labeler with the collated stream described in connection with FIG. 1. The magazines (books) are stacked in a particular orientation (to be described) in respective mailing hoppers 26, 28, 30 and 32 assigned to the demographic identifications described above. These hoppers in turn are equipped to deliver the books to a second chain conveyor 36 which in turn feeds the conveyor 24, a right angle turn intervening between the path of the conveyor 36 and the path of the conveyor 24. For clarity and understanding, we show a fifth mailing hopper 33 (ALL) FIG. 2 and this hopper contains the edition for all the nonprofessionals.

The precise manner in which the books are delivered from the mailing hoppers and the manner of accomplishing the right-angle turn are not features of the present invention as these movements involve established, standard mechanisms well known to those skilled in the art. It may be mentioned, however, that the assumption according to FIG. 2 is the mailing hoppers are directly above conveyor 36, not at one side, and that a program tape T, FIG. 2, bearing control indicia I, is the basic tool by which operation of the labeler 22 and sequential delivery from the mailing hoppers are synchronized so that (to continue the illustration given in FIG. 1) the first sequence of books to conveyor 36 is three magazines for the doctors from hopper 26, followed by two magazines for the lawyers from hopper 28, followed by the CHIEF edition (two books) from supply hopper 30, and finally the TAILOR edition (one book) from mailing hopper 32. In a purely descriptive sense the control indicia I on the tape T are sensed: labeler 22 receives its instructions along a channel 22C and the mailing hoppers are instructed along channels 26C, 28C, 30C, 32C and 33C, respectively.

The editions are determined at the signature gathering machine, not shown, where the content is varied accordingly as different signatures are gathered.

Figure 3:
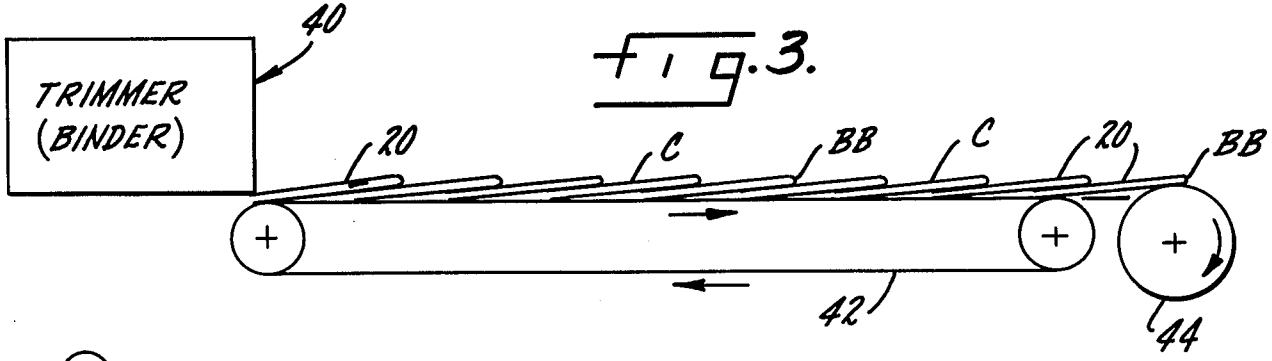
FIG. 3 is a schematic elevation showing the way the magazines are delivered from the trimmer.

Referring to FIG. 3, the books are delivered editionwise from the binder station 40 with the front cover C up in an imbricated or overlapped (shingled) stream to a conveyor 42 and from thence to an inverting cylinder 44; the backbones of the books delivered from the trimmer are in the leading attitude with the backbone of a trailing book lying atop the trailing end of a leading book, and this is the attitude which prevails as the books are delivered to the inverting roller 44.

Figure 4:
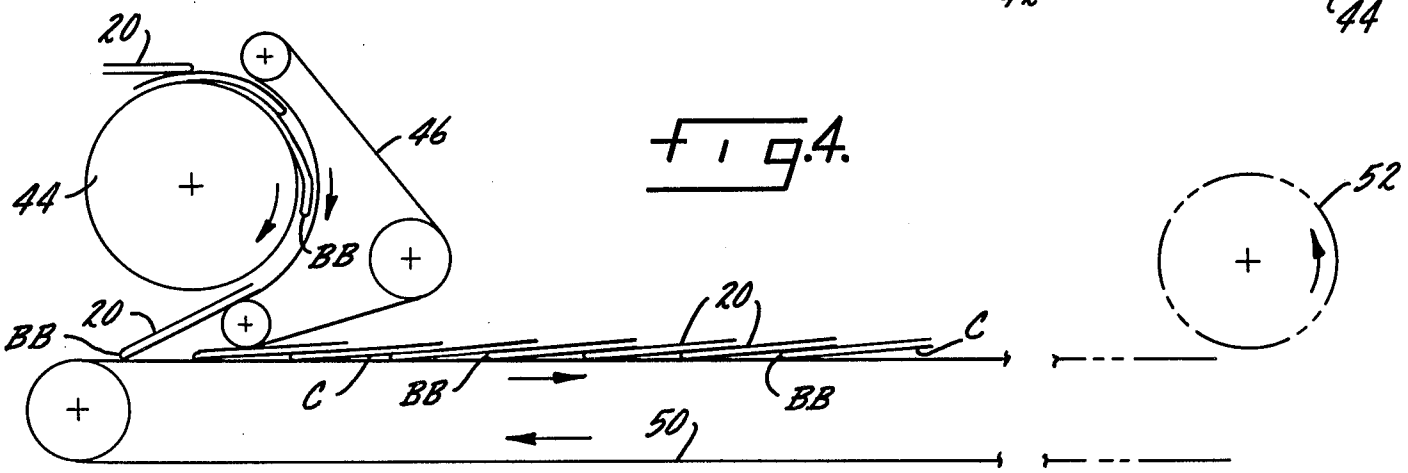
FIG. 4 is a schematic elevation showing a way for reorienting the magazines delivered from the trimmer.

The inverting roller 44, FIG. 4, is combined with an endless hold-down tape 46 so that the imbrication is maintained as the stream of books is delivered to the top of roller 44 for inversion. Another conveyor 50 is positioned beneath the inverting drum or cylinder 44 and its linear speed is assumed to be the same as that of the inverting drum which is the same as that of the conveyor 42 so that as the magazines are released onto conveyor 50 at the bottom of inverting drum 44 the same imbrication prevails but now the backbones are in trailing position while the front cover (which is to receive the label) faces downward. This inversion may have to be interposed as an incident under the present invention for reasons which will be apparent as the disclosure develops. This inversion may not always be necessary, however, depending upon whether the front cover or back cover is to be labeled; it depends also on what sort of feed mechanism is employed at the mailing hopper for feeding conveyor 36.

The conveyor 50 moves the books from left to right as viewed in FIG. 4, pointing the imbricated stream in the direction of a wrapup cylinder 52. The wrapup or windup cylinder or drum 52 is of known construction. More details are shown in FIG. 5 where the cylinder 52 is shown as rotating counterclockwise; a hold-down tape or clamping tape 54 (there may be a pair) has one end anchored to the cylinder to turn therewith. The tape is furnished by a supply roll 56. The tape 54 defines a bight (nip, or pinch angle) with the surface of opposed cylinder 52 and the imbricated stream of books 20 is fed into this bight so that books are pinched or clamped between the periphery of the drum and the opposed tape, resulting in the books being convolutely wound onto the wrap-up drum. In this manner the imbricated stream is in effect rolled up in a spool-like fashion by and on drum 52. The supply on the drum, when completed, or ended, represents the input of a particular edition to one of the mailing hoppers. For example, it may represent the entire input to mailing hopper 26. In other instances two or more supply drums may be required to complete the mailing (fulfillment) requirements for a particular edition. Again, this edition is represented by a signature content not present in a second or third edition being delivered at the binder.

The magazines on the supply drum 52 are to be fed into the appropriate mailing hopper, depending upon the particular edition, but the orientation is not yet completed. It will be recalled the mailing hoppers are directly over conveyor 36. The orientation of the magazines fed onto the conveyor 36 and from thence 90° to the conveyor 24 must be an orientation in which the backbone leads, FIG. 2, with the front cover up, but it can be seen from FIG. 4 in particular that when the magazines are removed from the wrap-up drum 52 (by reversing its direction of rotation) the front cover to receive the label is down, not up. The attitude or lead of the imbrication is also incorrect when the drum 52 is reversed to redeliver the magazines as will be apparent from the description to follow.

Referring to FIGS. 6 and 7, proper orientation for delivering the magazines into the mailing hopper (hopper 26, MD, for example) may be achieved by first breaking up the imbrication (FIG. 6), thereafter constructing a new imbrication, and once again inverting the books as shown in FIG. 7.

Thus, referring to FIG. 6, the supply drum 52, after first collecting the supply in the manner explained in connection with FIGS. 4 and 5, may be bodily transported to a location adjacent the mailing machine. Here the drum is unwound to feed a conveyor 55, FIG. 6, so the flow is from right to left as viewed in FIG. 6, the imbrication being maintained up to the nip presented by a pair of accelerating rollers 58. The leading edge of each book (BB) is advanced by the conveyor 55 into the nip of the accelerating rollers. Another conveyor 60 is positioned on the opposite side of the accelerating rollers 58 in a horizontal plane aligned to the roller bite or nip in position to receive and transport the books in a separated fashion, that is, the imbrication is disrupted by the speed difference so that the books 20 on the conveyor 60 are in spaced relationship, end to end; the front cover C is down and the backbone BB leads.

The magazines are now reimbricated, FIG. 7, for proper delivery in the direction (right to left as viewed in FIG. 7) to the receiving or mailing hopper 26 and this is accomplished by opposing a slower conveyor 62 to the conveyor 60 so that the books become once more imbricated with the backbone of a trailing book positioned atop the trailing end of a leading book.

It must be constantly borne in mind that we address a known construction of trimmer, mailing hopper, conveyor 36, labeler 22 and conveyor 24, with the right angle turn shown in FIG. 2 and with the mailing hopper constructed to operate as an incident to being positioned directly above conveyor 36. Consequently the magazines must be fed from this particular hopper onto conveyor 36 with the front cover C facing upwards and the backbone BB leading. Also, the conveyor 62 must be necessity feed the mailing hopper at the side of the hopper as shown in FIG. 2. Since the backbone BB of the magazine on the conveyor 62, FIG. 7, is 90° out of orientation (compared to the requirement when the magazine is on conveyor 36) this means the book 20 before it enters the mailing hopper (e.g. hopper 26, FIG. 2) must undergo a right angle turn indicated by a dashed line 62A, FIG. 2. Equipment (not shown but commercially available) is employed at 62A to turn the imbricated stream of books 90° into each of the mailing hoppers as they leave conveyor 62, and in FIG. 7 the same right angle bend is indicated by a different symbol 62A'.

The magazines are delivered one by one from the bottom of the mailing hopper 26 to an inverting cylinder 64. The inverting cylinder 64 is effective (in cooperation with an opposed band, not shown) to feed the magazines one by one to conveyor 36 with the backbone leading and the front cover up as it should be.

In other mailing machines there may be no right-angle turn between a conveyor as 24 and the upstream conveyor 36. Instead the stream may be straight through (viewed as an extension of the conveyor 24) in which event the mailing hoppers would be strung out along one side of the straight-through conveyor, shown as hoppers 26A, 28A and so forth in FIG. 2A. The magazines would then be fed from the mailing hoppers 26A, 28A with the backbone leading to comply with the orientation shown in FIG. 1, meaning that the conveyors 62 would be aimed directly at the center of each mailing hopper without the need for any intervening turn as 62A, 62A'.

Other arrangements are possible especially if the mailing hopper delivery mechanism is changed to one which does not invert the magazine being dropped onto conveyor 36: the shingle attitude can be reversed in the manner shown in FIG. 8; the supply on drum 52 could be unwound from the top of the drum rather than the bottom, and so on.

In any event, the point is that by programming the signature gathering machine for the editions, each edition delivered from the binder station (trimmer, FIG. 4) can be collected on an assigned cylinder as 52 and that same cylinder (or cylinders) can be assigned in turn to a corresponding mailing hopper until the edition requirement is fulfilled; there may be intervening steps to orient the cover and/or backbone and/or reverse the slant (slope) of the shingle.

The invention may also be practiced by a publisher concerned with pool cart mailing or match mailing of different magazines and again one plan is to pool production to save mailing costs by collating all magazines within a particular zip code. Thus, the publisher may be distributing on a monthly subscription basis the three magazines NOCKUM, ROCKUM and SOCKUM (respectively to gourmets, dancers and prize fighters). These are the editions to be collated by zip code and the wrap-up cylinders on which they are collated may be employed to supply feeders 26, 28 and 30 with feeders 32 and 33 being idled.

We claim:

1. A method of collating binder production of books in a sequence of different editions, which differ as to content, to another sequence on a conveyor so they will be delivered in the other sequence from the conveyor and comprising the following steps occurring in the following order between (1) a binder station where the books are bound and (2) a line of feeders, one for each edition, juxtaposed and equipped to deliver books one by one to said conveyor:

A. feeding the books in a continuous stream from the binder station as a separate edition to a wrap-up cylinder where that edition is spiral wound thereon as an imbricated supply;

B. completing a plurality of separate edition supplies each on its own wrap-up cylinder in compliance with step A;

C. assigning the wrapup cylinder supplies to the respective feeders by edition and unwinding the cylinders to release the books by edition while supplying each particular edition as it is being released to an assigned edition feeder so each feeder feeds only one edition; and D. programming the delivery of books from the feeders to the conveyor so the books are arranged on the conveyor one after another in the other sequence specified.

2. A method according to claim 1 in which the specified sequence is a zip code mailing sequence and in which the editions vary according to reader interest.

3. A method according to claim 1 in which the up or down attitude of the books as related to the front cover is reversed at some stage between the binder station and delivery thereof to the conveyor, and in which the lead of the imbrication is altered at some stage between the binder station and arrival of the books at the hoppers.

4. A method according to claim 2 in which the up or down attitude of the books as related to the front cover is reversed at some stage between the binder station and delivery thereof to the conveyor, and in which the lead of the imbrication is altered at some stage between the binder station and arrival of the books at the hoppers.

* * * * *